US008684073B2

(12) United States Patent
Sevheim et al.

(10) Patent No.: US 8,684,073 B2
(45) Date of Patent: Apr. 1, 2014

(54) DEVICE FOR INJECTION AND STIMULATION OF FLUIDS IN A WELL BORE

(75) Inventors: Ole Sevheim, Stavanger (NO); Øyvind Stokka, Sandnes (NO); Erling Kleppa, Jørpeland (NO); Magnar Tveiten, Sandnes (NO)

(73) Assignee: Petroleum Technology Company AS, Stavanger (NO)

( * ) Notice: Subject to any disclaimer, the term of this patent is extended or adjusted under 35 U.S.C. 154(b) by 618 days.

(21) Appl. No.: 12/866,895

(22) PCT Filed: Feb. 10, 2009

(86) PCT No.: PCT/NO2009/000047

§ 371 (c)(1),
(2), (4) Date: Nov. 8, 2010

(87) PCT Pub. No.: WO2009/102214

PCT Pub. Date: Aug. 20, 2009

(65) Prior Publication Data

US 2011/0042066 A1 Feb. 24, 2011

(30) Foreign Application Priority Data

Feb. 11, 2008 (NO) ..... 20080736

(51) Int. Cl.
*E21B 19/00* (2006.01)

(52) U.S. Cl.
USPC ..... 166/87.1; 166/95.1; 166/363; 166/364

(58) Field of Classification Search
USPC ..... 166/95.1, 90.1, 87.1, 368, 364, 363
See application file for complete search history.

(56) References Cited

U.S. PATENT DOCUMENTS

| | | | | |
|---|---|---|---|---|
| 2,921,601 | A * | 1/1960 | Fisher, Jr. | 137/496 |
| 3,973,586 | A * | 8/1976 | Hill et al. | 137/460 |
| 4,442,902 | A * | 4/1984 | Doremus et al. | 166/374 |
| 4,784,225 | A | 11/1988 | Petersen | |
| 4,832,126 | A * | 5/1989 | Roche | 166/358 |
| 5,004,007 | A * | 4/1991 | Johnson et al. | 137/501 |
| 6,102,626 | A * | 8/2000 | Milberger | 405/216 |
| 6,470,968 | B1 | 10/2002 | Turner | |
| 6,655,455 | B2 | 12/2003 | Bartlett et al. | |
| 7,322,407 | B2 | 1/2008 | Duhn et al. | |
| 7,350,562 | B2 * | 4/2008 | McGuire et al. | 166/85.1 |
| 7,770,653 | B2 * | 8/2010 | Hill et al. | 166/379 |
| 8,336,630 | B2 * | 12/2012 | Kerr | 166/352 |
| 8,347,916 | B2 * | 1/2013 | June | 137/613 |
| 2005/0006103 | A1 | 1/2005 | McGuire et al. | |

(Continued)

FOREIGN PATENT DOCUMENTS

| | | | |
|---|---|---|---|
| CA | 2462472 | A | 9/2005 |
| EP | 1278934 | A | 1/2003 |

(Continued)

*Primary Examiner* — David Andrews
*Assistant Examiner* — Kipp Wallace
(74) *Attorney, Agent, or Firm* — Christian D. Abel

(57) ABSTRACT

Present invention regards a device for injection and stimulation of fluids in a wellbore, where the device is typically is installed in Christmas trees, wellheads or subsea. The device comprises two separable sections, where the section that is mounted/arranged within the Christmas tree or wellhead, will remain in a closed position even if the other section due to external forces is broken off or in other ways is damaged.

12 Claims, 2 Drawing Sheets

(56) References Cited

U.S. PATENT DOCUMENTS

Figure 1:
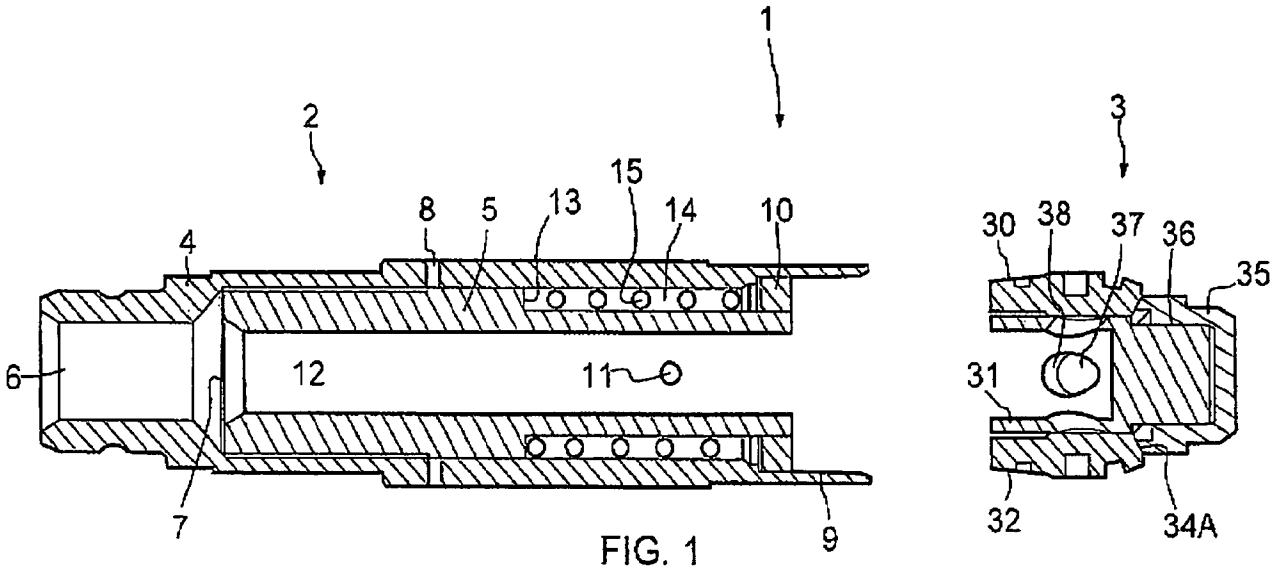

| | | | | |
|---|---|---|---|---|
| 2007/0215356 | A1* | 9/2007 | Leeb | 166/325 |
| 2007/0267198 | A1 | 11/2007 | McGuire | |
| 2010/0024907 | A1* | 2/2010 | Tibbitts | 137/614.04 |
| 2010/0116503 | A1* | 5/2010 | Leeb | 166/325 |

FOREIGN PATENT DOCUMENTS

| | | | |
|---|---|---|---|
| GB | 2233364 | A | 1/1991 |
| GB | 2377954 | A | 1/2003 |
| NO | 300392 | A | 6/1996 |
| NO | 311699 | A | 6/1996 |

* cited by examiner

DEVICE FOR INJECTION AND STIMULATION OF FLUIDS IN A WELL BORE

Present invention regards a device for injection and stimulation of fluids in a well bore, the device being typically installed in Christmas trees, surface wellheads or subsea wellheads, where the device will actively be opened by applying hydraulic pressure or actively closed by an elastic element, when no hydraulic force is pre sent. In the closed position the device will be acting as a fail safe closed barrier, even if the external lines should be damaged.

Gas lift valves installed inside the production tubing have been used for many years to allow for gas injection of compressed gas into oil and gas wells to assist in the production of wells fluids to the surface. These gas lift valves that are incorporated into the production tubing string are used to flow high pressure natural gas from the annulus to the interior of the production tubing. The gas that is injected is lighter than well bore fluid and it provides a lift to the column of fluid within the production tubing to assist the flow of fluid from the well.

These gas lift valves must reliably provide for one-way fluid flow only, from the annulus to the interior of the tubing, in order to prevent the undesirable leakage of production fluids into the annulus when the well is producing or closed for maintenance or repair. Unfortunately, many conventional gas lift designs are prone to wear and damage during operation that can lead to seal failure and leakage over time. One problem that is well-known is erosion of the sealing surfaces of the gas lift valve which result in leakage across the valve seat and reduced performance and a reduced lifetime for the valve devices. This creates a problem for operation of the well with increased down time, maintenance time and an increased safety hazard due to the annular volume not being isolated from the well flow Another problem is that the present annular volume of gas is exorbitant and it is therefore a desire to protect the platform from this annular volume should a damage to surface lines occur.

From a safety aspect there is a preference and a requirement for a double barrier philosophy in a welldesign where the present invention will be regarded as the second barrier installed in the Christmas tree or wellhead at surface or subsea, where the present and new invention will be a part of the barrier envelope to protect the platform or the surroundings from backflow of fluids should an undesired event take place.

Therefore one aim of the present invention will be to minimize and possibly alleviate these problems.

A further aim is to provide a device with a mtm (metal-to-metal) sealing of the device.

There is a further aim to provide a device with minimal flow restrictions and disturbances in the injection flow, giving reduced pressure losses across the device.

Still an aim is to provide a device that will remain in a closed position, this providing an intact wellhead, even if supply lines and/or the hydraulic device is exposed to external forces and due to these device arrangements is partly or complete damaged. Yet an another aim is to provide a device that is divided in operative sections where the part that is mounted internally inside a wellhead will remain in closed position inside the wellhead even if the other part that is outside the wellhead is damaged or broken off.

These aims are achieved by a device according to the following claims and alternative embodiments are given in the description.

The present invention regards a device designed for injection and stimulation of fluids in oil and gas wells. The device may also be used for chemical injection. This device, which is used to create a one-way seal within a Christmas tree or a wellhead flange outlet, is comprised of three separable sections where the section that is mounted inside the Christmas tree or the wellhead (surface/subsea)—referred to as a second section, will remain in a closed position even if the other sections due to a external force (impact, blow, stroke, hit etc.) is displaced, broken off or in other ways partly or completely damaged. The second section, that is mounted inside the Christmas tree or wellhead, is spring operated (fail safe closed) and the other sections is hydraulic operated fail safe closed spring assisted, where these sections are referred to as a first section and a hydraulic flange. The device according to the present invention is typically installed in connection with Christmas trees, wellheads (surface/subsea), where the device will actively be opened by applying hydraulic pressure or passively closed when no hydraulic force is present. In the closed position the device will be acting as a fail safe closed barrier, even if the external lines, injection or hydraulic supply lines will be damaged.

The device comprises two separable sections being connected with each other through a suitable device, for instance a connection piece. The first section, which is arranged and mounted outside a Christmas tree or a wellhead, within a specially built hydraulic flange, comprises an outer hollow housing with an internal body. The internal body is movable in the longitudinal direction of the housing, where movement of the internal body may be operated by pressure differential across the internal body. This pressure differential may be a fluid pressure operating on surfaces of the internal body, which surfaces may be exposed to different fluids. These fluids may be well fluids acting on one or more surfaces in order to operate the device, or injection fluid on one surface of the internal body and well fluid on another surface. According to an aspect of the present invention the pressure differential across the internal body may be assisted by at least one predetermined pressure balanced elastic element to open and close the device.

The internal body arranged within the hollow housing of the first section is provided with a thorough bore, and in one embodiment of the present invention the internal body may be designed as a full bore sleeve.

When the device is to be installed subsea, a tool is used to first fasten the specially built hydraulic flange on a Christmas tree or a wellhead. Then the second section of the device is mounted and secured within the Christmas tree or the wellhead in a known matter, where after the first section is inserted and installed within the hydraulic flange and is secured from being pushed out of the hydraulic flange by a stop arrangement. This stop arrangement may be a prepositioned gripper and expandable locking system. This stop arrangement may be designed in many ways and a skilled person will know how this can be done. The hydraulic flange is further arranged to be connected to the Christmas tree/wellhead through connection means, and is also provided with connection point for supply lines etc. A second section of the device is mounted within a Christmas tree or a wellhead (surface/subsea), and this section also comprises an outer hollow housing, whereby the hollow housings of the two sections can be connected together by a connection piece. Within the hollow housing is arranged an internal body that is movable in the longitudinal direction of the second section. According to the invention the internal body of the second section comprises an internal bore, which bore in a first closed position is closed with a metal to metal seal system between the outer housing and the internal body. Also the internal movable body of the second section may be operated by pressure differential across the internal body. This pressure differential may be a fluid pressure operating on surfaces of the internal body, which surfaces may be exposed to different fluids. These fluids may be well fluids on one or more surfaces for operating the device or injections fluid on one surface and well fluid on another surface or combinations. According to an aspect the pressure differential across the internal body may be assisted by at least one predetermined pressure balanced elastic element to close the device.

According to an aspect of the invention the two sections of the device are connected together by a connection piece, where the piece is in form of a sleeve that is interphasing the two sections, in such a way that the sleeve is covering a part of both of the sections. Furthermore, the piece that is laying over and covering the second section is arranged to have fingerlike taps around its periphery. These fingerlike taps may be of a weakened construction such that if the hydraulic flange with the first section are exposed to external forces and thereby damaged wholly or partly, the fingerlike taps will break off or bend resulting in that the first section is separated apart from the second section. The sleeve may on its outer side be arranged with an upstanding ring, where this will function as a stop surface when the device is mounted inside the Christmas tree/wellhead and the hydraulic flange. The Christmas tree/wellhead and the hydraulic flange must then on their insides have complementary recesses in which the ring can be locked. It is to be understood that other arrangement also can be used to achieve the locking and the breaking function of the connection piece, where a skilled person will know how this is done. According to the present invention the internal movable body of the second section of the device comprises of at least one slot between the bore and the outside of the internal body. These slots in the internal body are leading directly to the outside of the outer housing in an open position of the second section of the device, and are positioned within the outer housing in a closed position of the device. The part of the internal body comprising the slots are moved relative the outer housing from a position within the outer housing in a closed state of the valve to a position at least partly outside the housing in an open state of the valve.

According to an aspect of the invention the slots may be longitudinal and distributed on the circumference of the internal body. The distribution may be evenly around the circumference of the internal body. The form of the slot may be even or odd around the circumference of the body. The slots may be longitudinal with a main longitudinal direction mainly parallel with a longitudinal axis of the internal body. The slots may be longitudinal with a main direction at an angle relative to the longitudinal axis of the internal body or form a part spiral shape around a longitudinal axis, or formed with another shape. The slots around the internal body may also be of different shapes, whereof some may be larger than other slots.

According to another aspect the slots in the internal body may be made beveled and angled from an internal surface to an outer surface of the internal body in order to obtain stream line flow.

According to another aspect of the invention the seal system comprises a valve seat in the outer housing and a valve element sealing surface on the internal body. With open position one should in this description understand a position wherein the slots of the internal body are positioned with at least a part outside the outer housing seen in a direction transverse to the longitudinal axis of the device.

According to another aspect of the invention the valve seat and the valve element sealing surface in an open or partially open position are positioned on opposite sides of a slot seen in a longitudinal direction of the device. This gives that the slots forming the flow path of the injection fluid are positioned between the valve seat and the valve element sealing surface in an open position of the device.

According to another aspect of the invention the valve seat may comprise a low pressure guide to obtain optimal guiding sealing engagement as a secondary embodiment.

According to another aspect the internal body comprises a stop surface which in a fully open position of the device is abutting against a corresponding surface in the outer housing.

According to another aspect of the invention the internal body and outer housing may comprise corresponding parts of at least one guiding element predefining a travel between a closed and an open position of the device. In addition or alternatively the internal body may comprise at least one fluid balanced wing(s) or baffle(s) and or added slots in the internal surface of the internal body exposed to the injection fluid to guide the internal body in a predetermined travel between open and closed position of the device. This predefining travel may be linear, rotational and or a combination of this.

According to another aspect of the invention the outer housing may comprise a wiper element positioned to abut against and clean the sealing surface during closing of the device. This is favorable in the case when the injection fluid contains particles prone to be attached to the sealing surfaces.

According to another aspect of the invention the elastic element that is arranged in the first section of the device may comprise a spring element enclosed in a chamber, which chamber in one embodiment may be filled with a fluid separate from both well and injection fluid and which chamber in another embodiment may be in fluid contact with the internal bore of the internal body or the outside of the housing. According to yet another embodiment the outer housing and or the internal body of both of the sections may comprise several separable elements connected by for instance threaded joints. This gives the possibility to replace for instance the element of the outer housing comprising the valve seat without having to replace the whole housing.

The injection device of the present invention may also be positioned in a hydraulic spool piece in relation to a Christmas tree as mentioned above. The spool piece may be formed as a flange and comprise a main bore, in which main bore the injection device may be positioned. There may also be additional side bores for adding of hydraulic fluid and possible venting and pressure monitoring. The side bores may be adapted to be in communication with at least one opening in the outer housing of the injection device, in order to add hydraulic fluid for operation of the device. Such a system will be equipped with additional sealing elements in appropriate places and a skilled person will understand this. The device may also comprise a pretension means to set the device, i.e. the valve to a given position when hydraulic pressure is not present through the opening, for instance a closed position. The pretension device may be an elastic element such as spring or other pretension means These features of the invention will provide a device where the flow path of the injection fluid is substantially less tortuous than other known gas injection valves due to the more direct flow through the bore in the internal body and directly out through the slots of the valve. This also gives less pressure losses across the valve.

The present invention is also a device with few elements, compared with the majority of other known injection valves. This gives a more reliable device as well. The present invention also has a relatively large flow area through the device; compared with the majority of other known injection valve of similar size.

Furthermore, it is provided a device, comprised of separable section that will remain in a closed position even if the other section due to external force is displaced, broken off or in other ways partly or completely damaged.

Figure 3:
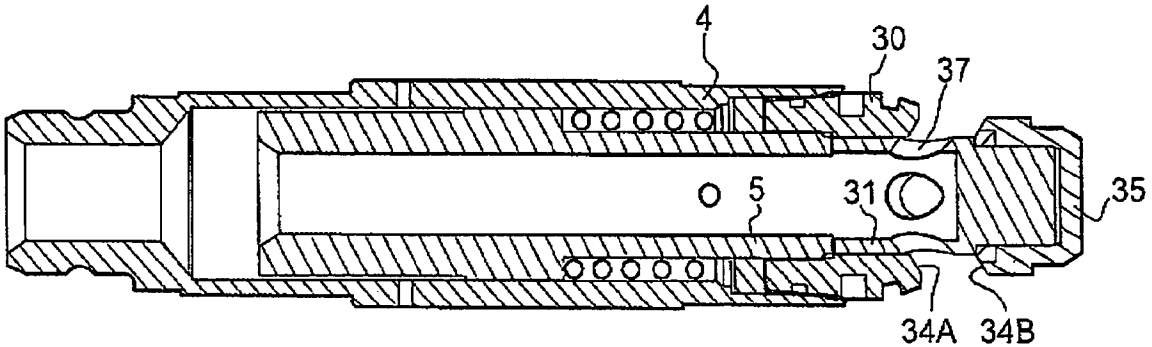
Figure 2:
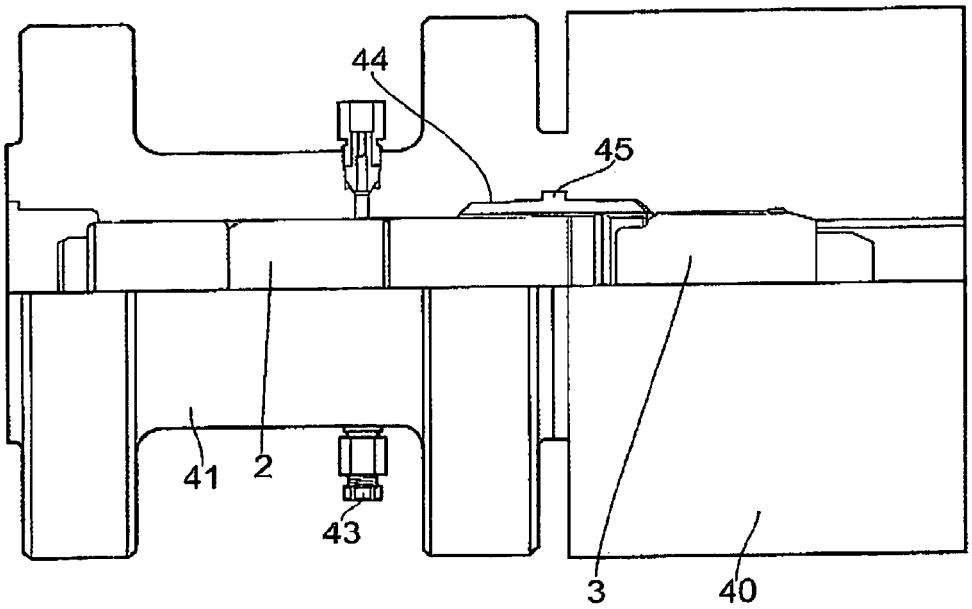

Following there will be given a non-limiting description of embodiment of the invention with reference to the accompanying drawing, where FIG. 1 shows a cross section of an embodiment of, the present invention in a closed position of the device, FIG. 2 shows a device according to the present invention, where the device is mounted within an arrangement subsea, and FIG. 3 shows the device in an open position.

From FIG. 1 can be seen an embodiment of the device 1, where the device 1 comprises two separable sections 2, 3. When the device 1 is installed subsea, the two sections 2, 3 are connected to each other through, a connection, but they will break loose if a first section 2 is exposed to an external force. In order to understand the present invention, the two sections 2, 3 are shown in an unconnected state.

The first section 2, which is arranged within a hydraulic flange 41 (see FIG. 2) mounted to a Christmas tree or a wellhead 3, comprises an outer hollow housing 4 and an internal body 5. Further, the internal body 5 is arranged movable within the longitudinal direction of the outer housing 4. The internal body is furthermore designed to be hollow, thereby providing a bore 12 through the internal body 5. In order to supply fluid through the device 1, the outer housing 4 is provided an inlet 6. There may in relation to this inlet 6 also be positioned an orifice 7 in a distance from the inlet 6, where the orifice 7 regulate the flow through the device 1, for instance to create a rotating flow pattern, in order to give the flow of fluid through the valve device 1 a most direct route with reduced pressure loss. There are also an aerating opening 8 in the outer housing 4 to prevent any trapped fluid between the internal body 5 and the outer housing 4 from stopping the movement between the internal body 5 and the outer housing 4. The aerating opening 8 may also be connected to a source of hydraulic fluid (not shown) in order to operate the device 1 between a closed and an open position. In such a configuration there will be appropriate sealing elements arranged between the internal body 2 and the outer housing 1 and a skilled person will understand how this is done.

The first section 2 further comprises an opening 11, connecting the internal bore 12 with an chamber 14 formed between the outer housing and the internal body and the stop surface 10 of the outer housing and a stop surface 13 formed in the outer wall of the internal body 5, limiting the movement of the internal body 2 relative the outer housing in the open state of the valve. in this chamber 14 an elastic element 15 may be arranged, where the elastic element will secure that the internal movable body 5 is pushed back in its initial position when no hydraulic pressure is applied to the device 1.

On an opposite end of the inlet 6, the outer hollow housing 4 of the first section 2 comprises a threaded part 9, which threaded part 9 can be connected to a threaded part 32 on a second section 3 of the device 1. A stop surface 10 is arranged on an inner surface of the outer hollow housing 4 and adjacent to the threaded part 9. The purpose of the stop surface 10 is to stop the movement of the internal body 5.

The second section 3 of the device 1 comprises an outer hollow housing 30 and an internal movable body 31 arranged within the outer housing 30. The internal movable body 31 is arranged with an internal bore 12. One end of the outer hollow housing 30 is arranged with a threaded part 32, which threaded part will co work with the threaded part 9 in the first section 2. An opposite end of the outer housing 30 will form one part of a sealing surface 34A, while the internal movable body 31 connected to an ending part 35 will form the other part of the sealing surface 34B. The internal movable body 31 is connected to the ending part 35 through a threaded connection 36. The outer hollow housing 30 and the internal bore 31 with the ending part 35 will in this way form a true metal-to-metal sealing. As the internal movable body 31 together with the ending part 35 will be lifted off the sealing surface 34A when the device 1 is opened, the sealing surface 34A will also function as a valve seat. Between the two scaling surfaces 34A and 34B may also a sealing element be positioned. As for the first section 2, also in the second section 3 is arranged between the outer hollow housing 30 and the internal movable body 31 an elastic element (not shown), where the elastic element will force back the internal movable body 31 to a closed position when no hydraulic pressure is applied to the device 1. A skilled person will know how this elastic element is to be arranged within the second section 3.

The threaded connection 9, 32 between the first and second section 2, 3 is a weakened connection such that it will break off or bend if the hydraulic flange, in which the first section 2 of the device 1 is arranged within, is subjected to an unforeseen external force (a blow or strike) this force leading to that the flange in knocked off or get out of the position.

In FIG. 2 the device 1 according to the present invention is shown in a connected and installed position within a Christmas tree/wellhead 40 and a hydraulic flange 41. When the device 1 is to be installed, a tool will guide the second section 3 through the flange 41 and into the Christmas tree/wellhead 40, where the second section 3 in known matter is secured within the Christmas tree/wellhead 40. Thereafter, the first section 2 of the device 1 is arranged in and through the threaded connection 9, 32 connected to the second section 3. When the two sections are connected together, a locking arrangement in the hydraulic flange 41 will lock the device 1, as to prevent the device 1 to move within the flange 41 and the Christmas tree/wellhead 40 when the device 1 is subjected to a pressurized fluid that is supplied to the device 1 through one or more connection points 43 for hydraulic lines, supply lines etc.

This lock arrangement (not shown) may be a pre positioned gripper and expandable locking system. The arrangement may be designed in many ways and a skilled person will know how this can be done. The hydraulic flange 41 is further arranged to be connected to the Christmas tree/wellhead 40 through connection means.

The two sections 2,3 of the device 1 are also connected together by a connection piece 44, where the piece is designed as a sleeve. When the device 1 is installed inside the Christmas tree/wellhead 40, the connection piece 44 is arranged to cover a part of both of the sections 2, 3. As the device 1 can separate into two sections 2, 3 if the device 1 is subjected to external forces, where the second section 3 will remain in a closed position, the connection piece 44 that is interphasing the second section 3 is arranged to have fingerlike taps around its periphery. These fingerlike taps are of a weakened construction such that if the hydraulic flange 41 with the first section 2 are exposed to external forces and thereby damaged wholly or partly, the fingerlike taps will break off resulting in that the first section 2 is separated apart from the second section 3. The connection piece 44 is on its outer side arranged with an upstanding ring 45, where this ring 45 will function as a stop surface when the device 1 is mounted inside the Christmas tree/wellhead 40 and the hydraulic flange 41. The Christmas tree/wellhead 40 and the hydraulic flange 41 must then on their insides have complementary recesses in which the ring 45 can be locked. As an alternative, one could also use the device to vent gas back out of the casing annulus. This can be done when the device is in an open position, where elements for overriding and or controlling the device are used to hold it in the open position. This will give a device that will return to or remain in its closed position if an unexpected or unwanted damage of the device will occur, as the weakened connections 9, 32 will break and separate the first section 2 and the second section 3 apart, whereby the second section will remain intact in its position within the Christmas tree/wellhead and it will furthermore remain in a closed position.

The invention has now been explained with an embodiment. Only elements related to the invention is described and a skilled person will understand that an outer housing or internal body may be formed in one unit or be comprised of several connected elements, and that the inlets have to be connected to a source of the fluid to be injected, that there should be appropriate attachment devices for attaching the valve within a process fluid stream and inside a hydraulic flange, and that there of course will be arranged for instance sealing element between several elements as a standard. The skilled person will also understand that one may make several alterations and modifications to the described and shown embodiment that are within the scope of the invention as defined in the following claims.

The invention claimed is:

1. Device (1) for injection of a fluids into a wellhead (40) via a flange (41) mounted to the wellhead (40), where the device (1) comprises an outer hollow housing (4, 30), an internal body (5, 31), and a seal system which is arranged between the outer housing (4, 30) and the internal body (5, 31), which internal body (5, 31) is movable within the outer housing (4, 30) between a closed position and an open position, in which closed position the seal system provides a fail-safe closed bather preventing a backflow of fluids, and in which open position the seal system allows the fluid to be injected through the device (1) and into the wellhead (40), characterized in that the device (1) comprises:

a first section (2) which comprises a first outer housing section (4) of the outer hollow housing and a first internal body section (5) of the internal body, which first section (2) is arranged to be mounted in the flange (41) on the outside of the wellhead (40), and a second section (3) which comprises a second outer housing section (30) of the outer hollow housing and a second internal body section (31) of the internal body, which second section (3) is arranged to be mounted inside the wellhead (40), wherein the first section (2) and the second section (3) are connected to each other via a connection piece (44) which allows the first section (2) to break off from the second section (3) leaving the second section (3) inside the wellhead in a fail-safe closed position should the flange (41) in which the first section (2) is mounted be subjected to an external force which partly or completely damages the first section (2).

2. Device according to claim 1, characterized in that the internal body (5, 31) is operated by a pressure differential across the internal body (5, 31), which pressure differential is assisted by at least one predetermined pressure balanced elastic element (15) to open and close the device.

3. Device according to claim 1, characterized in that the internal body (31) comprises slots (37) which are longitudinal and distributed on the circumference of the internal body (31).

4. Device according to claim 3, characterized in that the slots (37) in the internal body (31) are beveled and angled from an internal surface to an outer surface of the internal body (31) an or outer housing (32) in order to obtain a predetermined stream line flow.

5. Device according to claim 3, characterized in that the longitudinal slots in internal body (31) are parallel to a longitudinal direction of the device (1) or twisted or bend around the longitudinal axis.

6. Device according to claim 1, characterized in that the second section (3) comprises an ending part (35) which is connected to the second internal body section (31) through a threaded connection (36), and in that the seal system comprises a valve seat (34A) in the outer housing (30) and a valve element sealing surface (34B) on the ending part (35).

7. Device according to claim 1, characterized in that the device (1) further comprises elements for overriding and or controlling the open and or closed position of the device.

8. Device according to claim 1, characterized in that the outer housing (4) comprises a through going opening (8) for allowing hydraulic fluid to be added to the device (1) for operation between open and closed position of the device (1).

9. Device according to claim 2, characterized in that the elastic element (15) comprises a spring element enclosed in a chamber (14).

10. Device according to claim 6, characterized in that the valve element sealing surface (34B) in an open position of the device (1) is positioned outside an outer end of the outer housing (30).

11. Device according to claim 1, characterized in that the first section (2) and the second section (3) are connected to each other by threaded connections (9, 32) which are weakened connections.

12. Wellhead arrangement, comprising a wellhead (40), a flange (41) mounted to the wellhead (40) and a device (1) for injection of a fluid into the wellhead (40) via the flange (41), wherein the device (1) comprises an outer hollow housing (4, 30), an internal body (5, 31), and a seal system which is arranged between the outer housing (4, 30) and the internal body (5, 31), which internal body (5, 31) is movable within the outer housing (4, 30) between a closed position and an open position, in which closed position the seal system provides a fail-safe closed barrier preventing a backflow of fluids, and in which open position the seal system allows the fluid to be injected through the device (1) and into the wellhead (40), characterized in that the device (1) comprises:

a first section (2) which comprises a first outer housing section (4) of the outer hollow housing and a first internal body section (5) of the internal body, which first section (2) is arranged to be mounted in the flange (41) on the outside of the wellhead (40), and a second section (3) which comprises a second outer housing section (30) of the outer hollow housing and a second internal body section (31) of the internal body, which second section (3) is arranged to be mounted inside the wellhead (40), wherein the first section (2) and the second section (3) are connected to each other via a connection piece (44) which allows the first section (2) to break off from the second section (3) leaving the second section (3) inside the wellhead in a fail-safe closed position should the flange (41) in which the first section (2) is mounted be subjected to an external force which partly or completely damages the first section (2).

* * * * *